US007621345B2

(12) United States Patent
Cepeda et al.

(10) Patent No.: US 7,621,345 B2
(45) Date of Patent: Nov. 24, 2009

(54) HIGH DENSITY ROW ON ROLLER CONE BIT

(75) Inventors: Karlos B. Cepeda, Fort Worth, TX (US); Robert J. Buske, The Woodlands, TX (US); James L. Overstreet, Tomball, TX (US); Rolf C. Pessier, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 228 days.

(21) Appl. No.: 11/695,460

(22) Filed: Apr. 2, 2007

(65) Prior Publication Data

US 2007/0227781 A1 Oct. 4, 2007

Related U.S. Application Data

(60) Provisional application No. 60/788,766, filed on Apr. 3, 2006.

(51) Int. Cl.
*E21B 10/16* (2006.01)

(52) U.S. Cl. ..... 175/341; 175/378

(58) Field of Classification Search ..... 175/378, 175/341, 331

See application file for complete search history.

(56) References Cited

U.S. PATENT DOCUMENTS

| | | | | | |
|---|---|---|---|---|---|
| 2,177,332 | A * | 10/1939 | Reed | 175/376 |
| 2,482,263 | A * | 9/1949 | Goodwin | 175/361 |
| 2,533,258 | A * | 12/1950 | Morlan et al. | 175/378 |
| 2,994,390 | A * | 8/1961 | Hildebrandt | 175/378 |
| 3,223,188 | A * | 12/1965 | Coulter, Jr. et al. | 175/341 |
| 3,726,350 | A | 4/1973 | Pessier | |
| 3,945,447 | A * | 3/1976 | Peterson | 175/349 |
| 4,393,948 | A * | 7/1983 | Fernandez | 175/374 |
| 5,311,958 | A | 5/1994 | Isbell et al. | |
| 6,401,839 | B1 * | 6/2002 | Chen | 175/57 |
| 6,530,441 | B1 * | 3/2003 | Singh et al. | 175/431 |
| 6,942,045 | B2 * | 9/2005 | Dennis | 175/378 |
| 7,040,424 | B2 * | 5/2006 | Yong et al. | 175/374 |
| 7,195,086 | B2 * | 3/2007 | Aaron et al. | 175/374 |
| 7,334,652 | B2 * | 2/2008 | Chen et al. | 175/374 |
| 7,370,711 | B2 * | 5/2008 | Singh | 175/77 |
| 2001/0007290 | A1 * | 7/2001 | Saxman | 175/374 |
| 2002/0023783 | A1 * | 2/2002 | Skyles | 175/371 |
| 2003/0136588 | A1 * | 7/2003 | Truax et al. | 175/376 |
| 2005/0167161 | A1 * | 8/2005 | Aaron et al. | 175/331 |
| 2006/0219442 | A1 * | 10/2006 | Felderhoff et al. | 175/331 |
| 2007/0034411 | A1 * | 2/2007 | Singh | 175/77 |
| 2008/0029308 | A1 * | 2/2008 | Chen | 175/331 |

* cited by examiner

*Primary Examiner*—Shane Bomar
(74) *Attorney, Agent, or Firm*—Bracewell & Giuliani LLP

(57) ABSTRACT

An earth-boring bit has a high density row on one of its cones. Each cone has a nose area and a gage area with a heel row of teeth at the gage area. One of the cones has a farther intermediate row of teeth and another one of the cones has a closer intermediate row of teeth. The remaining cone has a high density row of teeth, which is located closer to the axis of rotation of the bit than the farther intermediate row and farther from the axis of rotation of the bit than the closer intermediate row. The high density row has a smaller pitch between crests of the teeth than the closer and farther intermediate rows. The smaller pitch provides more teeth in the high density row than in the closer intermediate row and the farther intermediate row.

17 Claims, 3 Drawing Sheets

HIGH DENSITY ROW ON ROLLER CONE BIT

CROSS-REFERENCE TO RELATED APPLICATION

This application claims priority to provisional application 60/788,766, filed Apr. 3, 2006.

FIELD OF THE INVENTION

This invention relates in general to an earth-boring bit cone and in particular to a rolling cone earth-boring bit having a row of teeth that has a higher density than adjacent rows on other cones of the bit.

BACKGROUND OF THE INVENTION

FIG. 1 illustrates a typical prior art earth-boring bit 11. Bit 11 has a bit body 13 that is threaded at its upper end for connection into a drill string. Bit body 13 has a number of pressure compensating lubricant reservoirs 15. Bit body 13 is also provided with at least one nozzle 17, which discharges drilling fluid from down the drill string to cool bit 11 and wash cuttings produced during drilling out of the borehole.

A plurality of cones 19, 21 are mounted for rotation on cantilevered bearing pins. In this prior art example, there are three cones, but only two are shown. Cones 19, 21 are shown with a plurality of teeth 23, each having a crest 25 that extends parallel with an axis of rotation of each cone 19, 21. During drilling operation, cones 19, 21 roll over the bottom of the borehole being drilled while teeth 23 penetrate and disintegrate the earth's formation.

Prior art bits similar to that illustrated in FIG. 1 have a shortcoming that becomes particularly apparent during drilling of formations, such as shales, that behave plastically. During drilling of these formations, conventionally arranged teeth 23 tend to fall into indentations made by the same or another tooth 23 on a previous revolution of bit 11. This condition is known as tracking and can seriously impair the penetration rate, life and performance of bit 11.

Another shortcoming of the prior art bit illustrated in FIG. 1 is that formation material may become packed between teeth 23, preventing teeth 23 from penetrating the formation deeply and thereby reducing the rate of penetration of bit 11. This condition is known as balling. Balling, like tracking, prevents the teeth 23 from penetrating to fall depth, thus resulting in inefficient and costly drilling. Balling also prevents the force on crests 25 of teeth 23 from reaching the level sufficient to fracture rock.

The characteristics of both tracking and balling are well recognized, but generally are treated as independent problems. In many cases, features that reduce tracking promote balling, and vice versa. For example, balling is more likely to occur between closely spaced teeth. Large and widely spaced teeth are more prone to tracking.

SUMMARY

The bit of this invention has a plurality of cones, each having at least one intermediate row of teeth. At least one of the intermediate rows on at least one of the cones is a high density row. The high density row is spaced farther from the bit axis than a closer one of the intermediate rows on at least one of the other cones. The high density row has a lesser pitch than the pitch of the closer one of the intermediate rows.

In the preferred embodiment, each of the teeth of the high density row has a height substantially the same as the height of the teeth of the closer one of the intermediate rows. Each of the teeth of the high density row and the closer one of the intermediate rows has a leading flank and a trailing flank and an included angle therebetween. The included angle of the teeth of the high density row is preferably substantially the same as the included angle of the teeth of the closer one of the intermediate rows. Each of the teeth of the high density row has a leading flank and trailing flank. The leading flank of one tooth in the high density row intersects the trailing flank of an adjacent tooth without any circumferential gaps in the example shown.

In the example shown, at least one of the intermediate rows on one of the cones, other than the cone containing the high density row, is located farther from the bit axis than the high density row and has a pitch greater than the pitch of the high density row. The high density row has more teeth than the closer one of the intermediate rows and the farther one of the intermediate rows. Inner and outer grooves adjoin inner and outer sides of the high density row. Preferably, each groove has a width at least equal to a width of the high density row measured at bases of the teeth of the high density row.

DETAILED DESCRIPTION OF THE INVENTION

Figure 1:
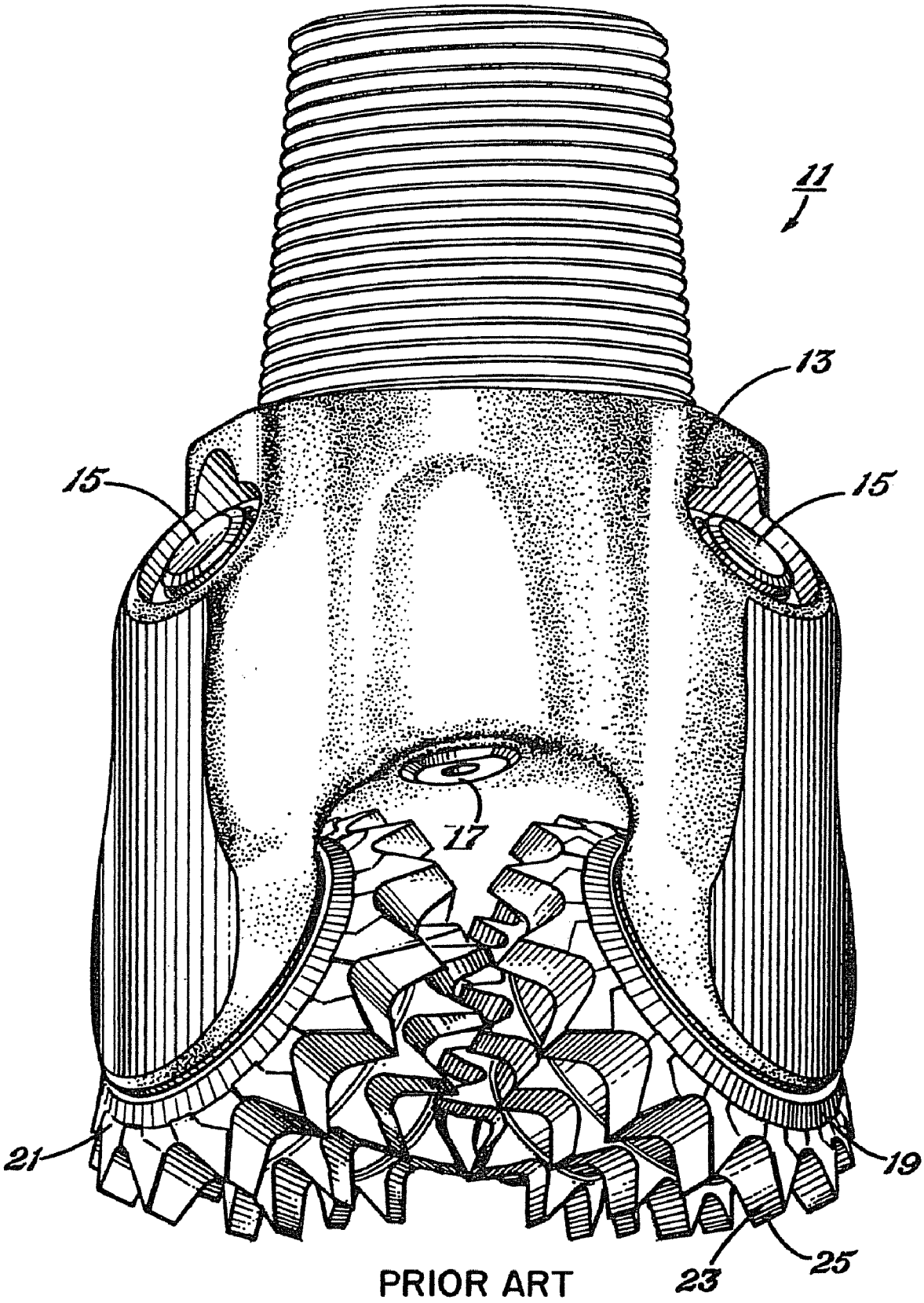
PRIOR ART Fig. 1
FIG. 1 is a side elevational view of a prior art earth-boring bit.
Figure 2:
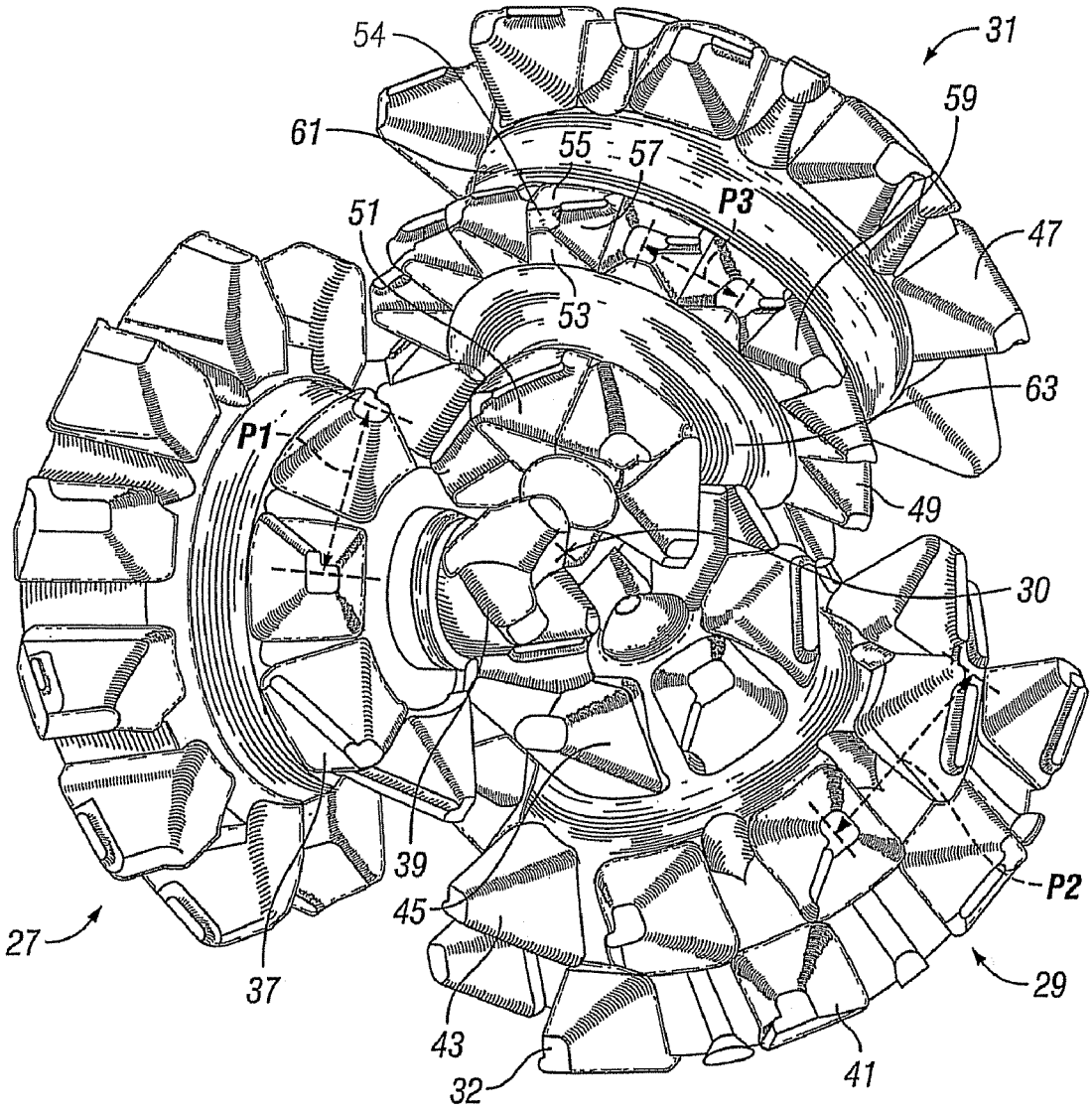
FIG. 2 is a bottom view of an earth-boring bit constructed in accordance with this invention.
Figure 3:
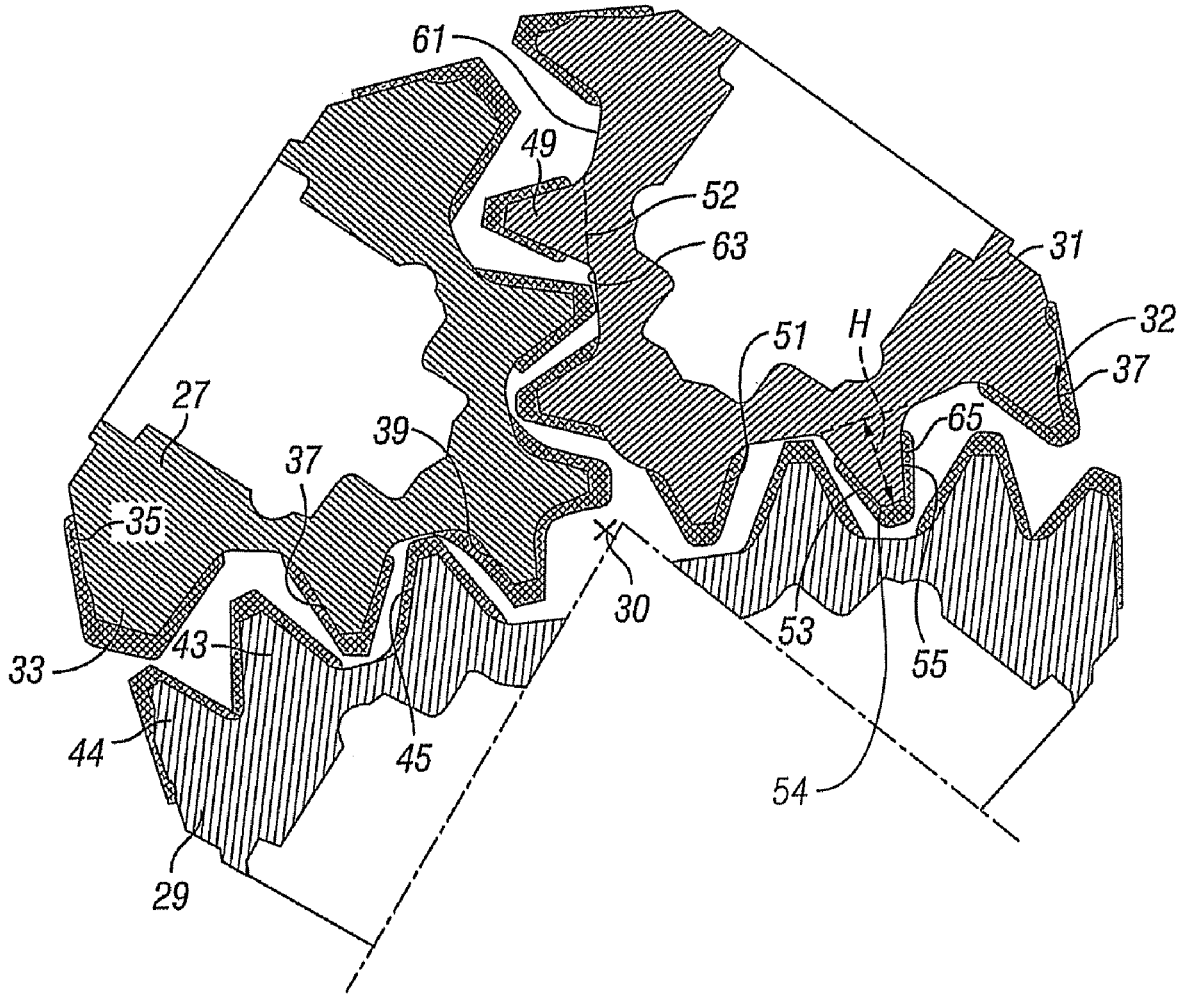
FIG. 3 is a cross-sectional layout of the earth-boring bit of FIG. 2.

Referring to FIGS. 2 and 3, cones 27, 29 and 31 are suitable for mounting to an earth-boring bit as shown in FIG. 1 in place of the cones illustrated in FIG. 1. Cones 27, 29 and 31 have rows of cutting elements, which in this embodiment comprise teeth 32 that are integrally formed in the supporting metal of each cone, such as by milling. In this example, cone 27 has teeth 32 arranged in rows in a conventional manner. These rows include a heel row 33 located adjacent gage surface 35 of cone 27. One or more intermediate rows 37 (only one shown) are spaced inward from heel row 33. A spear point 39 defines an innermost row of teeth 32, spear point 39 being formed at the apex or nose of cone 27.

Similarly, cone 29 has teeth 32 arranged in a conventional manner in this example. The rows on cone 29 include a heel row 41, at least one intermediate row 43 (only one shown) and an inner row 45. As shown in the layout of FIG. 3, intermediate row 43, also termed farther intermediate row, is located farther from bit axis 30 than intermediate row 37, which is referred to herein as closer intermediate row 37. Inner row 45 is also located farther from bit axis 30 than spear point 39 of cone 27.

In this embodiment, cone 31 is configured in accordance with this invention. Cone 31 has a heel row 47, at least one intermediate row 49 (only one shown), also referred to as high density row 49, and an inner row 51 located in the nose area of the cone. High density row 49 is located closer to bit axis of rotation 30 than farther intermediate row 43 and farther from bit axis 30 than closer intermediate row 37. Each tooth 32 in high density row 47 is the same distance from gage surface 35 of cone 31. Heel row 47 and inner row 51 may be conventional and constructed as in the prior art. Preferably, high density row 49 differs from the prior art in that it has more teeth 32 than the intermediate row of a comparable prior art bit. Preferably, high density row 49 has more teeth 32 than farther intermediate row 43 and than closer intermediate row 37 and its teeth are more closely spaced to each other.

Each tooth 32 of the intermediate rows 37, 43 and 49 has a base 52 where it joins the supporting metal of the particular cone 27, 29 or 31. In a transverse cross-section of each tooth 32 where it joins the supporting metal, base 52 would appear to be generally rectangular in this embodiment. Each tooth 32 has an inner side or flank 53 and an outer flank 55 on its inner and outer sides, relative to bit axis 30. Inner and outer flanks 53, 55 converge toward each other from opposite edges of base 52 to a blunt crest 54. As shown in FIG. 2, each tooth 32 has a leading flank 57 and a trailing flank 59, considering the direction of rotation of each cone 27, 29, or 31. Leading and trailing flanks 57, 59 converge toward each other from opposite edges of base 52 (FIG. 3) to crest 54. The angle of convergence, or included angle between leading and trailing flanks 57 of each tooth 32 is preferably substantially the same for all of the intermediate rows 37, 43 and 49.

The height H (FIG. 3) of each tooth 32 is considered herein to be the length of a line extending normal to base 52 and intersecting crest 54. Preferably, the heights H of each tooth 32 of the intermediate rows 37, 43 and 49 are substantially the same.

An outer groove 61 joins the outer side of high density row 49 and an inner groove 63 joins the inner side of high density row 49. Inner and outer grooves 61, 63 are conical sections of supporting metal extending around cone 31. Base 52 of each tooth 32 of high density row 49 is substantially flush with inner and outer grooves 61, 63, thus height H for high density row 49 extends from the level of inner and outer grooves 61, 63 to crest 54. The width of each groove 61, 63 is preferably at least equal to the maximum thickness of each tooth 32 of high density row 49. The maximum thickness is the distance at base 52 between inner and outer flanks 53, 55. As shown in FIG. 3, high density row 49 of cone 31 intermeshes between intermediate row 37 of cone 27 and intermediate row 43 of cone 29. Farther intermediate row 43 intermeshes within outer groove 61 between heel row 47 and high density row 49 of cone 31. Closer intermediate row 37 intermeshes within inner groove 63 between inner row 51 and high density row 49 of cone 31.

Leading and trailing flanks 57, 59 of adjacent teeth 32 of high density row 49 intersect or join each other, creating a V-shaped valley between adjoining teeth 32. There are no circumferentially extending spaces or gaps between where the leading and trailing flanks 57, 59 of adjacent teeth 32 of high density row 49 join the supporting metal of cone 31. Stated another matter, the bases 52 of adjacent teeth 32 in high density row 49 substantially adjoin each other, without any spaces between. By contrast, bases 52 of adjacent teeth 32 in intermediate rows 37 and 43 of cones 27 and 29 are circumferentially spaced apart from each other. Intermediate row 37 of cone 27 has a circumferentially extending gap between where the leading flank 57 of one tooth 32 and the trailing flank 59 of an adjacent tooth 32 join the supporting metal. Intermediate row 43 of cone 29 has an even larger circumferential gap between each leading flank 57 and trailing flank 59 of adjacent teeth where flanks 57, 59 join the supporting metal.

The pitch P3 is the distance from the center of crest 54 of one tooth 32 to the center of the crest of the adjacent tooth 32 of high density row 49. Pitch P3 is in the range from 25 to 75 percent of pitch P2 of farther intermediate row 43 and 25 to 75 percent of pitch P1 of closer intermediate row 37. In the embodiment shown, pitch P3 is 50 percent of pitch P2 and 50 percent of pitch P1. In cones 27 and 29, there are more teeth in farther intermediate row 43 than closer intermediate row 37 because the diameter of cone 29 is greater at farther intermediate row 43 than the diameter of cone 27 at closer intermediate row 37. Because of the smaller pitch P3, even though the diameter of cone 31 at high density row 49 is less than at the diameter of cone 29 at farther intermediate row 43, there are more teeth 32 in high density row 49 than in farther intermediate row 43. There are more teeth in high density row 49 than closer intermediate row 37 because of the smaller pitch P3 and the greater diameter of cone 31 at high density row 49 than the diameter of cone 27 at closer intermediate row 37. The additional number of teeth 32 in high density row 49 may be up to twice the amount of intermediate rows 37 or 43, depending upon the difference in pitches P1, P2 and P3.

Hardfacing 65 is shown schematically on teeth 32 in the layout of FIG. 3 to illustrate the intermeshing engagement of the intermediate rows 37, 43 and 49. During operation, high density row 49 helps to break up tracking or buildup of rock formation occurring between the widely spaced teeth within intermediate rows 37 and 43. The wide inner and outer grooves 61, 63 allow for the sideways displacement of cuttings and resist balling in high density row 49.

While the invention has been shown in only one of its forms, it should be apparent to those skilled in the art that it is not so limited but is susceptible to various changes without departing from the scope of the invention. For example, although each cone is shown with only one intermediate row, the invention is applicable to cones that have more than one intermediate row. In addition, more than one high density row may be employed. The invention is also applicable to bits having tungsten carbide inserts pressed into mating holes in the cones, rather than integrally formed metal teeth.

The invention claimed is:

1. An earth-boring bit, comprising:

a bit body having a bit axis of rotation;

a plurality of cones, each having a circumferential intermediate row of cutting elements located adjacent to a heel row of cutting elements;

at least one of the intermediate rows on at least one of the cones being a high density row, each cuffing element in the high density row being spaced the same distance from a gage surface of the cone containing the high density row, and when the cones are viewed in a cross sectional layout, the high density row being spaced farther from the bit axis of rotation than a closer one of the intermediate rows one of the other cones; and the high density row having more cuffing elements than the closer one of the intermediate rows.

2. The bit according to claim 1, wherein:

each of the cuffing elements of the high density row has a height substantially the same as a height of the cuffing elements of the closer one of the intermediate rows.

3. The bit according to claim 1, wherein:

each of the cuffing elements of the high density row and the closer one of the intermediate rows has a leading flank and a trailing flank and an included angle therebetween; and the included angle of the cuffing elements of the high density row is substantially the same as the included angle of the cuffing elements of the closer one of the intermediate rows.

4. The bit according to claim 1, wherein:

each of the cuffing elements of the high density row comprises a tooth formed from supporting metal of the cone containing the high density row, and each of the cuffing elements of the high density row has a leading flank and trailing flank; and the leading flank of each cutting element of the high density row intersects the trailing flank of an adjacent cuffing element in the high density row.

5. The bit according to claim 1, wherein:

the number of cuffing elements of the high density row is in the range from 25 to 75 percent greater than the closer one of the intermediate rows.

6. The bit according to claim 1, wherein when the cones are viewed in a cross sectional layout, a farther one of the intermediate rows on one of the cones other than the cone containing the high density row is located farther from the bit axis of rotation than the high density row and has fewer cutting elements than the high density row.

7. The bit according to claim 1, wherein:

when the cones are viewed in a cross sectional layout, a farther one of the intermediate rows on one of the cones other than the cone containing the high density row is located farther from the bit axis of rotation than the high density row, the high density row being between the farther one and the closer one of the intermediate rows; and the high density row has more cuffing elements than the farther one of the intermediate rows.

8. The bit according to claim 1, wherein:

inner and outer grooves adjoin inner and outer sides of the high density row and extend circumferentially around the cone containing the high density row; and each groove has a width at least equal to a width of the high density row measured at bases of the cuffing elements of the high density row.

9. An earth-boring bit, comprising:

a bit body having a bit axis of rotation;

a plurality of cones, each having a circumferential intermediate row of cuffing elements located next to a heel row of cuffing elements, each of the cuffing elements comprising a tooth formed from supporting metal of its cone;

each of the cuffing elements of each intermediate row being the same distance from a gage surface of its cone as the other cuffing elements within the same intermediate row;

at least one of the intermediate rows on at least one of the cones being a high density row, and when viewed in a cross sectional layout, the high density row being spaced closer to the bit axis of rotation than a farther one of the intermediate rows on one of the other cones and farther from the bit axis of rotation than a closer one of the intermediate rows on still another one of the other cones; and the high density row having more cutting elements than the farther one and the closer one of the intermediate rows;

each of the cutting elements of the high density row has a leading flank and trailing flank; and the leading flank of each cutting element in the high density row intersects the trailing flank of an adjacent cutting element of the high density row without any circumferential gap therebetween.

10. The bit according to claim 9, wherein:

each of the cutting elements of the high density row has a height substantially the same as the height of the cutting elements of the farther one of the intermediate rows.

11. The bit according to claim 9, wherein:

each of the cutting elements of the high density row and the farther one of the intermediate rows has a leading flank and a trailing flank and an included angle therebetween; and the included angle of the cutting elements of the high density row is substantially the same as the included angle of the cutting elements of the farther one of the intermediate rows.

12. An earth-boring bit, comprising:

three rotatable cones, each having a nose area and a gage area with a heel row of cuffing elements adjacent the gage area;

a circumferential farther intermediate row of cuffing elements between the heel row and the nose area on at least one of the cones;

a circumferential closer intermediate row of cuffing elements between the heel row and the nose area on another one of the cones and located closer to an axis of rotation of the bit than the farther intermediate row;

a circumferential high density row of cuffing elements located between the heel row and the nose area of still another of the cones, the high density row being located closer to the axis of rotation of the bit than the farther intermediate row and farther from the axis of rotation of the bit than the closer intermediate row, each of the cuffing elements of the high density row being located the same distance to the gage area of the cone containing the high density row; and the high density row having more cutting elements than the closer intermediate row and the farther intermediate row.

13. The bit according to claim 12, wherein:

each cuffing element of the farther intermediate row, the closer intermediate row, and the high density row comprises a tooth formed of supporting metal of the cone, each of the teeth having a base where it joins supporting metal of the cone, a crest at its tip, and a height measured from the base to the crest; and the heights of each of the cuffing elements of the farther intermediate row, the closer intermediate row and the high density row are substantially the same.

14. The bit according to claim 12, wherein:

each cuffing element of the high density row comprises a tooth formed of supporting metal of the cone, each of the teeth, each of the teeth having a base where it joins supporting metal of the cone and a thickness measured between an outer side and an inner side of the cuffing element at the base; and inner and outer grooves adjoin inner and outer sides of the high density row, each of the grooves having a width at least equal to the thickness of each of the cutting elements of the high density row.

15. The bit according to claim 12, wherein:

each of the cuffing elements of the closer intermediate row, the farther intermediate row, and the high density row has a leading flank and a trailing flank and an included angle therebetween; and the included angle of the cutting elements of the high density row is substantially the same as the included angle of the cutting elements of the closer and farther intermediate rows.

16. The bit according to claim 12, wherein:

each of the cutting elements of the high density row comprises a tooth formed from supporting metal of its cone, each of the cutting elements having a leading flank and a trailing flank; and the leading flank and trailing flank of each of the cutting elements of the high density row join flanks of adjacent cuffing elements without any circumferential gaps therebetween.

17. The bit according to claim 12, wherein:

the high density row has a smaller pitch between its cutting elements than a pitch of the closer intermediate row and a pitch of the farther intermediate row.

* * * * *